United States Patent [19]

Wiley et al.

[11] Patent Number: 4,598,825

[45] Date of Patent: Jul. 8, 1986

[54] CORNER PROTECTOR FOR PICTURE FRAMES AND THE LIKE

[75] Inventors: Teddy E. Wiley; James C. Payne, both of Russellville, Ark.

[73] Assignee: International Paper Company, New York, N.Y.

[21] Appl. No.: 686,945

[22] Filed: Dec. 27, 1984

[51] Int. Cl.[4] ..... B65D 85/48; A47G 1/06

[52] U.S. Cl. ..... 206/453; 206/454; 206/586; 229/87 R; 40/152; 40/154

[58] Field of Search ..... 206/220, 453, 454, 586; 229/87 R, DIG. 1; 40/154, 152, 152.1, 156; 108/56.1

[56] References Cited

U.S. PATENT DOCUMENTS

| | | | |
|---|---|---|---|
| 1,667,279 | 4/1928 | Allen | 206/453 |
| 2,509,468 | 5/1950 | Anderson, Jr. | 206/453 |
| 2,885,139 | 5/1959 | Werner et al. | 206/453 |
| 2,951,669 | 9/1960 | Davidson | 108/56.1 |
| 4,127,192 | 11/1978 | Card | 206/586 |
| 4,134,496 | 1/1979 | Smith | 206/453 |
| 4,375,261 | 3/1983 | Kitchell | 206/320 |
| 4,479,318 | 10/1984 | Russell | 206/454 |

*Primary Examiner*—Joseph Man-Fu Moy
*Assistant Examiner*—David T. Fidei
*Attorney, Agent, or Firm*—Jay S. Cinamon

[57] ABSTRACT

A rectangular or square shipping package or wrapper for a picture frame, mirror, or the like, having four corner protective forming elements is made from a one-piece, die-cut blank of corrugated board, paperboard or fiberboard with the corner protectors being defined by four, multi-paneled, fold-out flaps capable of capture from the confines of the blank and foldable into a plurality of corner protective pockets, each of the flaps being located in a separate quadrant of the blank.

2 Claims, 9 Drawing Figures

CORNER PROTECTOR FOR PICTURE FRAMES AND THE LIKE

BACKGROUND OF THE INVENTION

1. Field of the Invention

This invention relates to a unitary package for protecting all four corners, as well as the back, of rectangular or square articles, such as a picture frame, mirror or the like during the time it is in transit or storage. It also can serve as a display means, when the situation requires it to function as such.

2. Description of the Prior Art

The packages used previously to protect picture frames or the like always had a much greater surface area than the object to be contained therein, resulting in a needless waste of board. Further waste of board was occasioned by the corner protective elements of prior art wrappers being formed from extensions to the blank, such as U.S. Pat. No. 4,479,318, rather than being capable of capture from the interior of the blank itself. Additionally, the prior art packages typically required the use of ancillary materials, such as glue or staples, to effect closure of the wrapper or package. Another alternative was to employ individualized corner protectors on each of the corners of the article being protected.

SUMMARY OF THE INVENTION

In accordance with the present invention, a rectangular or square shipping package or wrapper, for a picture frame, mirror, or the like, having four corner protective forming elements is made from a one-piece, die-cut blank of corrugated board, paperboard or fiber board with the corner protectors being defined by four, multi-paneled, fold-out flaps capable of capture from the confines of the blank and foldable into a plurality of corner protective pockets, each of the flaps being located in a separate quadrant of the blank. The pocket also includes, as part of the flap, an inner triangular panel which locks into the picture frame and a frictional engaging panel which maintains the pocket in position.

DETAILED DESCRIPTION OF THE INVENTION

Figure 1:
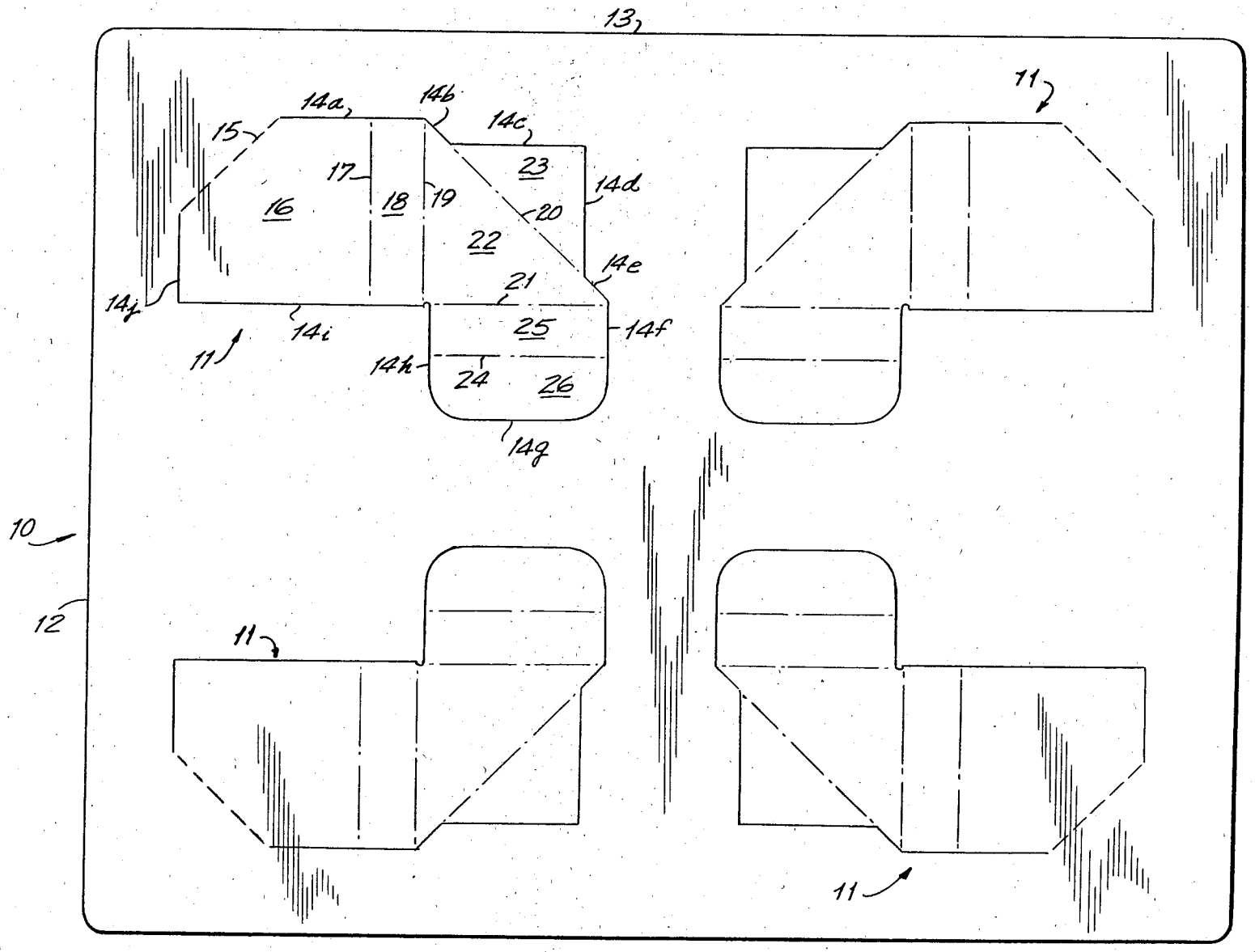
FIG. 1 is a top plan view of the blank for forming the wrapper of the present invention.

Referring now to the drawing in detail, wherein like numerals indicate like elements throughout the several views, the corner-protective wrapper or package of the present invention is formed from a unitary, planar, rectangular or square blank 10, made of corrugated paperboard, paperboard, fiber board, etc., as shown in FIG. 1.

Since all four of the flaps are similarly configured, and the folding sequence to arrive at each corner protective element is the same, reference will be made to only one of such flaps for purposes of description, but shall be deemed to include all.

Flap 11 is a die-cut irregularly shaped, eleven-sided polygon which is laterally offset from vertical edge 12 and horizontal edge 13 which define the perimeter of blank 10. If one were to draw imaginary horizontal (x) and vertical (y) axis' centrally of the blank the flaps 11 would be located in the northeast, northwest, southwest and southeast quadrants, respectively, of the blank 10. The polygonal flap is defined by continuous cut line 14 having segments 14*a–j* inclusive. The flap is hinged to the blank 10 by diagonal score line 15.

Turning now to a more detailed description of flap 11, pentagonal backing panel 16 is defined by vertical score line 17, diagonal hinge score 15, and cut line segments 14*a*, 14*i*, and 14*j*. Top corner forming panel 18 is defined by vertical parallel score lines 17 and 19 and segments 14*a* and 14*i* of cut line 14. Diagonal score line 20, vertical score line 19, horizontal score line 21 and segments 14*b* and 14*e* define triangular face panel 22. Internal triangular panel 23 is defined by diagonal score line 20 and segments 14*c* and 14*d*. While it is preferred to employ panel 23, in certain applications it need not be present. Parallel horizontal score lines 21 and 24 and portions of segments 14*f* and 14*h* define side corner forming panel 25. Frictional engaging panel 26 is defined by horizontal score line 24 and cut line segments 14*f*, 14*g* and 14*h*.

Figure 2:
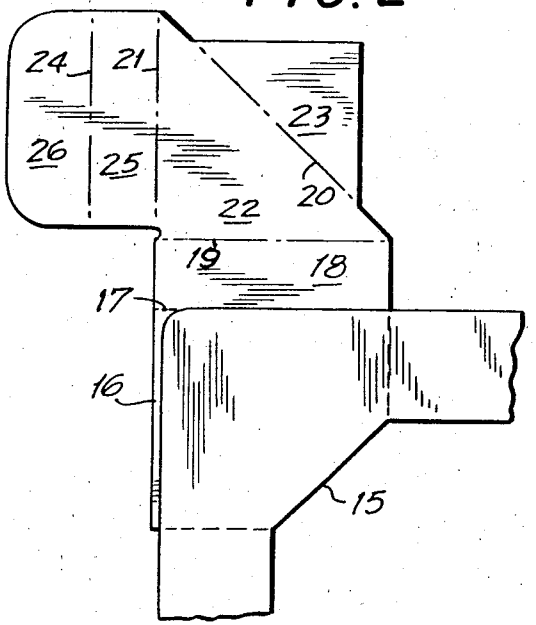
FIG. 2 is a fragmentary plan view of one of the four flaps after being strack from the plane of the blank and folded substantially 180°.

FIG. 2 depicts the first folding step in the assembly of the package of the present invention. The multi-paneled flap 11 is struck from the plane of the blank 10 and moved through an angle of substantially 180°. In this attitude, the pentagonal backing panel 16 is substantially in face-to-face contact with the back surface of the blank with fold line 17 generally coincident with horizontal edge 13 of blank 10. In this view, corner forming panels 18, 20, 21, 24 and 25 are still in an upstanding position prior to initiating the formation of corner pocket 27 (see FIG. 6) to protect a corner of a picture.

Figure 3:
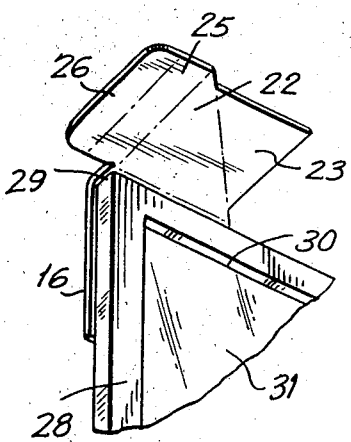
FIGS. 3–6, inclusive, are fragmentary plan views depicting the assembly of a corner protective element onto a picture frame from the flap of FIG. 2.

FIG. 3 illustrates the initiation of the folding sequence which results in the formation of corner pocket 27. In this figure, a picture frame 28 having a corner 29, a flange 30 and a glass surface 31 is shown ready for inclusion and assembly into the picture frame package of the present invention. In this view the top corner panel 18 is shown being folded substantially 90° so that it overlies the top edge of frame 28.

Figure 4:
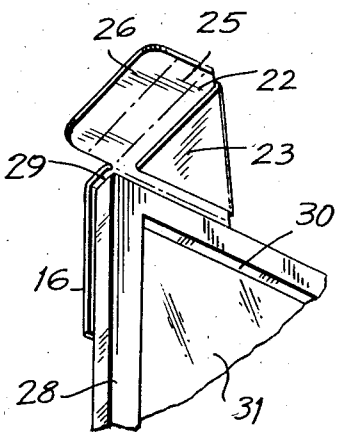

In FIG. 4 the folding sequence is continued with internal triangular panel 23 being brought into contact with the inner surface of triangular face panel 22.

Figure 5:
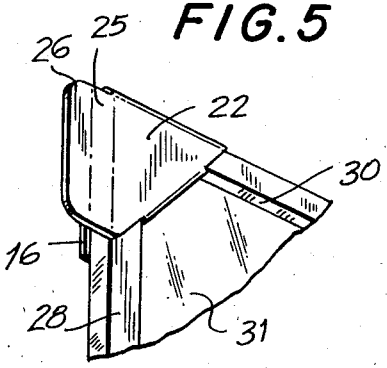

Thereafter, as shown in FIG. 5, internal triangular panel 23 is folded through an angle of substantially 90° to complete the establishment of top corner panel 18 and face panel 22 of triangular corner pocket 27. In this view the side corner panel 25 and frictional engaging panel 26 are laterally offset outwardly of picture frame 28.

Figure 6:
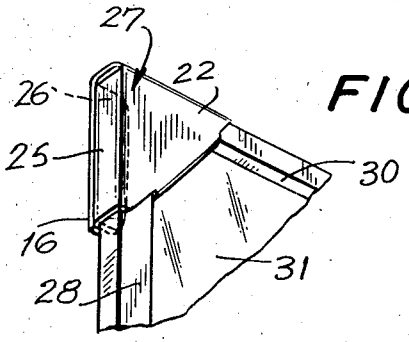

In FIG. 6, after completion of the final folding step, the side corner panel 25, which has been folded substantially 90°, overlies a portion of the side edge of frame 28. Frictional engaging panel 25 is folded through two substantially 90° angles from its attitude in FIG. 5 and is inserted between backing panel 16 and that portion of blank 10 which lies above diagonal hinged line 15. In this view one can see the triangular corner pocket 27 formed about the corner 29 of frame 28.

Figure 7:
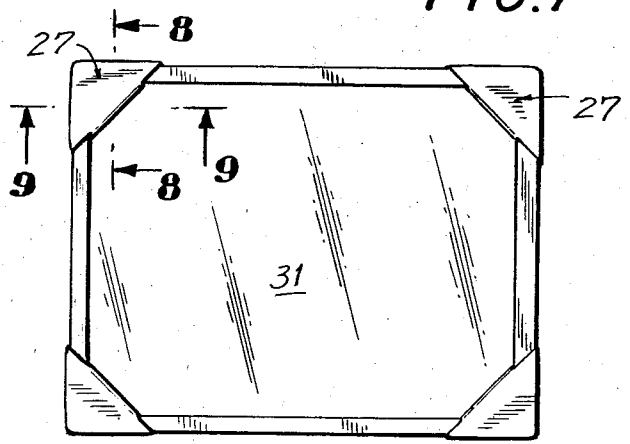
FIG. 7 is a plan view of a picture frame within the now assembled package depicting four corner protective elements.

FIG. 7 depicts the assembled package and the inserted picture frame with all four of its corners protected within the confines of corner receiving pocket 27.

Figure 8:
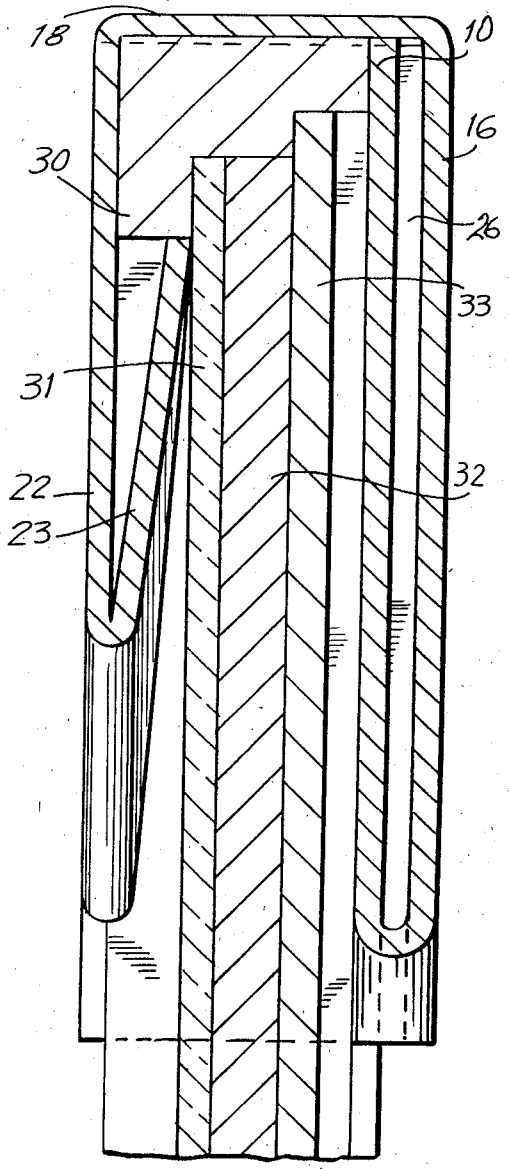
FIG. 8 is a cross sectional view taken along the line 8—8 of FIG. 7.

FIG. 8 is a vertical cross sectional view which permits ready visualization of the various surfaces forming the pocket 27, and the manner in which the picture frame is received therein. Outer triangular panel 27 forms the outer surface or face of pocket 27 and top corner panel 18 forms the top surface thereof. In this view one can also see frictional engaging panel 26 sandwiched between backing panel 16 and the rear portion of the blank 10, which forms the rear surface of the pocket and serves to maintain and lock corner pocket 27 in position. Also it can be seen how the apex of inner triangular panel 23 which is located interiorly of pocket 27 engages the flange 30 of the picture frame, having a glass surface 31 overlying picture of photograph 32 and a rear backing 33, thus filling the void between the glass and the frame in order to maintain it in a fixed position.

Figure 9:
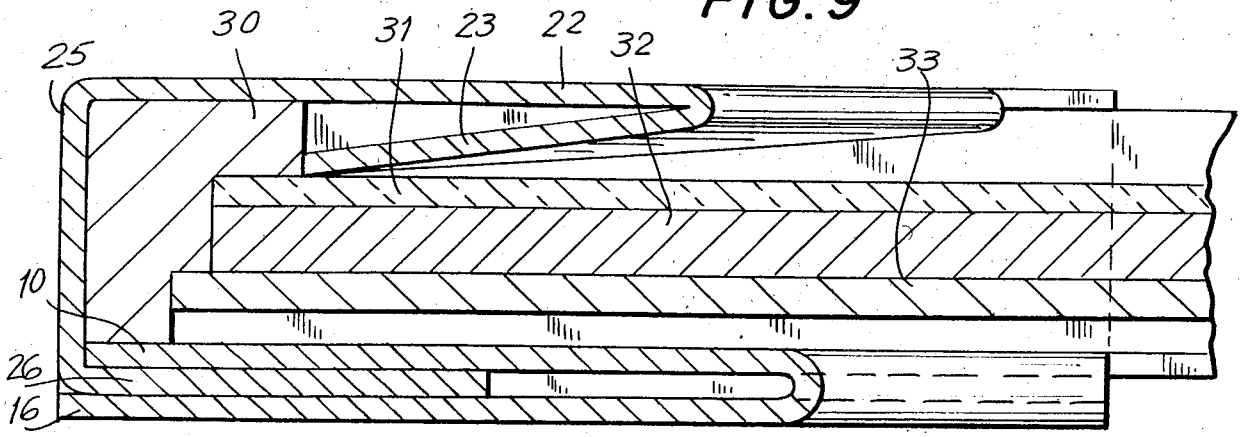
FIG. 9 is a cross sectional view taken along the line 9—9 of FIG. 7.

FIG. 9 is a horizontal cross-sectional view along the line 9—9 of FIG. 7. As in FIG. 8, one can readily see the orientation of the various panel elements, including side corner panel 25 which forms the side surface of the pocket, and their manner of cooperating to maintain the picture frame in a fixed position within triangular corner pocket 27.

As can be appreciated from the foregoing description, the present invention provides a unique and superior package for protecting the corners of articles having a rectangular or square configuration formed from a single sheet of flat corrugated board or paperboard where the corners are captured from the interior thereof. The package of the present invention can also be used to protect desk tops, table tops, doors and a variety of similarly configured items during shipment, storage and handling.

It is to be understood that the invention is not limited to the exact details of construction, operation, or exact materials or embodiments shown and described as obvious modification and equivalents will be apparent to one skilled in the art, and the invention is therefore to be limited only by the scope of the appended claims.

What is claimed is:

1. A package formed from a blank of corrugated board, paperboard or the like for protecting the corners of an article packaged therein, such as a picture frame or the like, which comprises:

(a) said blank having a plurality of polygonal, die-cut, multi-paneled flaps captured from the interior of the blank and adapted to be formed into a corner of the packaged article;

(b) each of said flaps comprised of a series of foldably interconnected corner forming panels, namely, a backing panel, a top corner panel, a triangular face panel, an inner triangular panel, a side corner panel, and a frictional engaging panel;

(c) said multi-paneled flap being folded though an angle of substantially 180 degrees whereby the inner face of the backing panel is in substantially face-to-face contact with a surface of the blank;

(d) folding the remaining corner forming panels to create a corner receiving pocket, comprised of:

(i) the top and side corner forming panels being foldably connected at an angle of substantially 90 degrees;

(ii) the triangular face panel forming the outer surface of the corner receiving pocket and being foldably connected along one side to the top corner panel and along another side to the side corner panel;

(iii) an internal triangular panel being foldably connected to the triangular face panel along its third side with its apex located interiorly of the corner receiving pocket whereby it maintains the picture frame in position;

(iv) a frictional engaging panel foldably connected to the side corner panel and disposed in frictional engagement between the backing panel and the surface of the blank whereby the corner receiving pocket is maintained in position.

2. A package formed from a blank of corrugated board, paperboard or the like for protecting the corners of an article packaged therein, such as a picture frame or the like, which comprises:

(a) said blank having a plurality of polygonal, die-cut, multi-paneled flaps captured from the interior of the blank and adapted to be formed into a corner of the packaged article;

(b) each of said flaps comprised of a series of foldably interconnected corner forming panels, namely, a backing panel, a top corner panel, a triangular face panel, a side corner panel, and a frictional engaging panel;

(c) said multi-paneled flap being folded though an angle of substantially 180 degrees whereby the inner face of the backing panel is in substantially face-to-face contact with a surface of the blank;

(d) folding the remaining corner forming panels to create a corner receiving pocket, comprised of:

(i) the top and side corner forming panels being foldably connected at an angle of substantially 90 degrees;

(ii) the triangular face panel forming the outer surface of the corner receiving pocket and being foldably connected along one side to the top corner panel and along another side to the side corner panel;

(iii) a frictional engaging panel foldably connected to the side corner panel and disposed in frictional engagement between the backing panel and the surface of the blank whereby the corner receiving pocket is maintained in position.

* * * * *